US007542704B2

(12) United States Patent
Okuda et al.

(10) Patent No.: US 7,542,704 B2
(45) **Date of Patent: *Jun. 2, 2009**

(54) TONER CARRIER APPARATUS, TONER FEEDING APPARATUS, AND IMAGE FORMING APPARATUS

(75) Inventors: Takeshi Okuda, Kizugawa (JP); Yasuyuki Ishiguro, Higashiosaka (JP); Takeshi Wakabayashi, Kizugawa (JP); Jun Yamaguchi, Ikoma (JP); Hiroshi Kawahito, Kitakatsuragi-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/826,426

(22) Filed: Jul. 16, 2007

(65) Prior Publication Data

US 2008/0031657 A1 Feb. 7, 2008

(30) Foreign Application Priority Data

Aug. 2, 2006 (JP) ..... 2006-211370

(51) Int. Cl.
*G03G 15/08* (2006.01)

(52) U.S. Cl. ..... 399/258

(58) Field of Classification Search ..... 399/258–262, 399/358–360

See application file for complete search history.

(56) References Cited

U.S. PATENT DOCUMENTS

| | | | |
|---|---|---|---|
| 4,840,460 | A | 6/1989 | Bernot et al. |
| 5,126,865 | A | 6/1992 | Sarma |
| 6,366,755 | B1 | 4/2002 | Takashima |
| 7,395,015 | B2 | 7/2008 | Ishiguro et al. |
| 2006/0228134 | A1 * | 10/2006 | Ishiguro et al. |
| 2007/0008444 | A1 | 1/2007 | Nakanishi et al. |

FOREIGN PATENT DOCUMENTS

| | | | | |
|---|---|---|---|---|
| JP | 1-73862 | U | | 5/1989 |
| JP | 1-191884 | A | | 8/1989 |
| JP | 2-12 | A | | 1/1990 |
| JP | 04-174467 | | | 6/1992 |
| JP | 10-239977 | A | | 9/1998 |
| JP | 11-242418 | A | | 9/1999 |
| JP | 3076938 | B2 | | 6/2000 |
| JP | 2002278257 | A | * | 9/2002 |
| JP | 2003-167413 | A | | 6/2003 |
| JP | 2005049850 | A | * | 2/2005 |
| JP | 2005-165003 | | | 6/2005 |

OTHER PUBLICATIONS

Japanese Office Action and English translation mailed Sep. 9, 2008 in corresponding JP application 2006-211370.

* cited by examiner

*Primary Examiner*—David M Gray
*Assistant Examiner*—Erika Villaluna
(74) *Attorney, Agent, or Firm*—Nixon & Vanderhye, P.C.

(57) ABSTRACT

Accumulation and coagulation of toner inside a vertically-disposed toner carrying path is properly prevented. The toner carrier apparatus includes: a toner carrier pipe which includes therein a toner carrying path through which toner is carried and is disposed so that the toner carrier path vertically extends; a pipe supporting member which supports the toner carrier pipe in such a way as to allow the toner carrier pipe to be vertically movable; a rotational member and operation wings, which cause the toner carrier pipe to reciprocally move in the vertical direction and horizontally swing; and a knocking mechanism which horizontally hits the toner carrier pipe.

14 Claims, 8 Drawing Sheets

TONER CARRIER APPARATUS, TONER FEEDING APPARATUS, AND IMAGE FORMING APPARATUS

This Nonprovisional application claims priority under 35 U.S.C. § 119(a) on Patent Application No. 211370/2006 filed in Japan on Aug. 2, 2006, the entire contents of which are hereby incorporated by reference.

FIELD OF THE INVENTION

The present invention relates to a toner carrier apparatus which carries toner, a toner feeding apparatus including the toner carrier apparatus, and an image forming apparatus including the toner feeding apparatus.

BACKGROUND

Electrophotographic image forming apparatuses such as photocopiers, printers, and facsimile machines have conventionally been known. Such an image forming apparatus forms an electrostatic latent image on the surface of a photoconductor, develops the electrostatic latent image by using toner, transfers the obtained toner image onto a sheet, and fixes the image. The toner for developing an electrostatic latent image is supplied from a developing apparatus to the surface of the photoconductor. To the developing apparatus, the toner is supplied from a toner cartridge, via the toner carrier apparatus. In a case where the toner cartridge is provided above the developing apparatus, the toner carrier apparatus has a toner carrying path which is vertically provided.

Since nowadays image forming apparatuses are capable of forming high-quality images, the particle size of toner has become small. Toner with small particle size typically has a low fluidity, and hence such toner tends to accumulate or coagulate in the toner carrying path of the toner carrier apparatus. A toner carrier apparatus therefore should solve such a problem.

For example, in an apparatus disclosed in Japanese Laid-Open Patent Application No. 4-174467 (published on Jun. 22, 1992), four developing devices corresponding to respective colors are provided along the vertical direction, and a toner hopper (equivalent to the toner cartridge) supplies toner to these developing devices. Each of the developing devices can move vertically, because the device is required to face a photoconductor, when the device is used. In this connection, the toner carrying path by which toner is supplied from the toner hopper to the developing devices is an accordion pipe. Also, on the side face of the accordion pipe, a rotational member is provided. This rotational member has plural protrusions in the circumferential direction, and is rotated by a motor. In other words, Japanese Laid-Open Patent Application No. 4-174467 (published on Jun. 22, 1992) teaches that the rotational member is rotated so that the outer surface of the accordion pipe is repeatedly knocked by the protrusions on the rotational member, with the result that toner remaining in the folds on the inner surface of the accordion pipe drops.

In an apparatus disclosed in Japanese Laid-Open Patent Application No. 2001-296731 (published on Oct. 26, 2001), four developing apparatuses corresponding to respective colors line up from left to right, and toner is supplied to the developing apparatus from respective toner cartridges, via first and second carrying paths. In the second toner carrying path provided in the vertical direction, a spring agitator is provided. This spring agitator vertically rocks in accordance with the rotation of an auger provided in the first carrying path which is laterally provided. In other words, Japanese Laid-Open Patent Application No. 2001-296731 (published on Oct. 26, 2001) teaches that the spring agitator vertically rocks inside the second carrying path so that adhesion of toner onto the inner wall of the second carrying path is prevented.

Japanese Laid-Open Patent Application No. 2005- 165003 (published on Jun. 23, 2005) proposes an image forming apparatus in which a communicating part between a supply pipe and a developing device is narrow. In this image forming apparatus, the narrow communicating part is widened on the occasion of toner supply, and toner is liquidized by vibrating the communicating part so that the toner is supplied to the developing device. This communicating part is made of an elastic material, in order to prevent the vibration from being transferred to the surroundings.

These conventional techniques, however, are disadvantageous in that it is not possible to properly prevent toner from accumulating or coagulating in the toner carrying path which is vertically provided.

More specifically, according to Japanese Laid-Open Patent Application No. 4-174467 (published on Jun. 22, 1992), since the vertical toner carrying path is an accordion pipe, the structure of the carrying path makes it difficult to prevent toner from accumulating or coagulating in the toner carrying path. Moreover, because a part of the toner carrying path is knocked or vibrated by the rotating member, toner tends to accumulate or coagulate at a portion away from the rotating member.

According to Japanese Laid-Open Patent Application No. 2001-296731 (published on Oct. 26, 2001), the spring agitator is provided in the vertically-provided second carrying path. On this account, toner tends to accumulate or coagulate on the surface of the spring agitator. In short, the spring agitator is liable to obstruct the carrying of toner.

According to Japanese Laid-Open Patent Application No. 2005-165003 (published on Jun. 23, 2005), the narrow communicating part vibrates at the time of supplying toner.

However, since the communicating section is made of an elastic material and hence absorbs vibration, the vibration is not sufficiently transferred from the origin of vibration. On this account, toner is likely to accumulate or coagulate at a portion away from the origin of vibration, as in the case of the document 1.

BRIEF SUMMARY

The present technology seeks to solve the problem mentioned above, e.g., preventing toner from accumulating or coagulating inside a vertically-disposed toner carrying path.

A toner carrier apparatus of an example embodiment includes: a toner carrier member which includes therein a toner carrying path through which toner is carried, the toner carrier member being disposed so that the toner carrying path vertically extends; a supporting member which supports the toner carrier member in such a way as to allow the toner carrier member to be vertically movable; a drive mechanism which vertically moves the toner carrier member; and a vibration mechanism which vibrates the toner carrier member.

According to this arrangement, the toner carrier member is supported by the supporting member in such as manner as to vertically movable, and is vertically moved by the drive mechanism. With this, the entirety of the toner carrier member is evenly rocked in the vertical direction. It is therefore possible to prevent toner from accumulating and coagulating in the toner carrying path of the toner carrier member.

Moreover, according to the arrangement above, the toner carrier member is vibrated by the vibration mechanism. Due to the vibration, toner inside the toner carrying path is easily broken up. This further ensures the prevention of accumulation and coagulation of toner.

This makes it possible to properly prevent, with a simple arrangement, accumulation and coagulation of toner in the toner carrying path (as compared to a case where a spring agitator [which is liable to cause accumulation of toner] is provided on the toner carrying path and a case where the toner carrier member is, for example, accordion-shaped.

Toner feeding apparatus of an example embodiment therefore includes: the aforesaid toner carrier apparatus; a toner supply apparatus disposed above the toner carrier apparatus; and a developing apparatus which is disposed below the toner carrier apparatus and which receives toner from the toner supply apparatus via the toner carrier apparatus.

In an example embodiment image forming apparatus is provided with the aforesaid toner feeding apparatus.

To achieve the objective above, an image forming apparatus of the present invention is provided with the aforesaid toner feeding apparatus.

Since each of the toner feeding apparatus and the image forming apparatus is provided with the aforesaid toner carrier apparatus, it is possible to properly prevent toner from accumulating and coagulating in the toner carrying path.

Additional objects, features, and strengths of the present technology will be made clear by the description below. Further, the advantages of the present technology will be evident from the following explanation in reference to the drawings.

BRIEF DESCRIPTION OF THE DRAWINGS

FIG. 3(*b*) is a side view of the toner carrier apparatus shown in FIG. 1.

FIG. 4(*b*) is a vertical cross section of the same toner carrier apparatus, when the shutter is opened.

FIG. 9(*b*) shows a state where, in the toner carrier apparatus shown in FIG. 1, the knocking section of the lever is not in contact with the toner carrier pipe.

DESCRIPTION OF THE EMBODIMENTS

Figure 2:
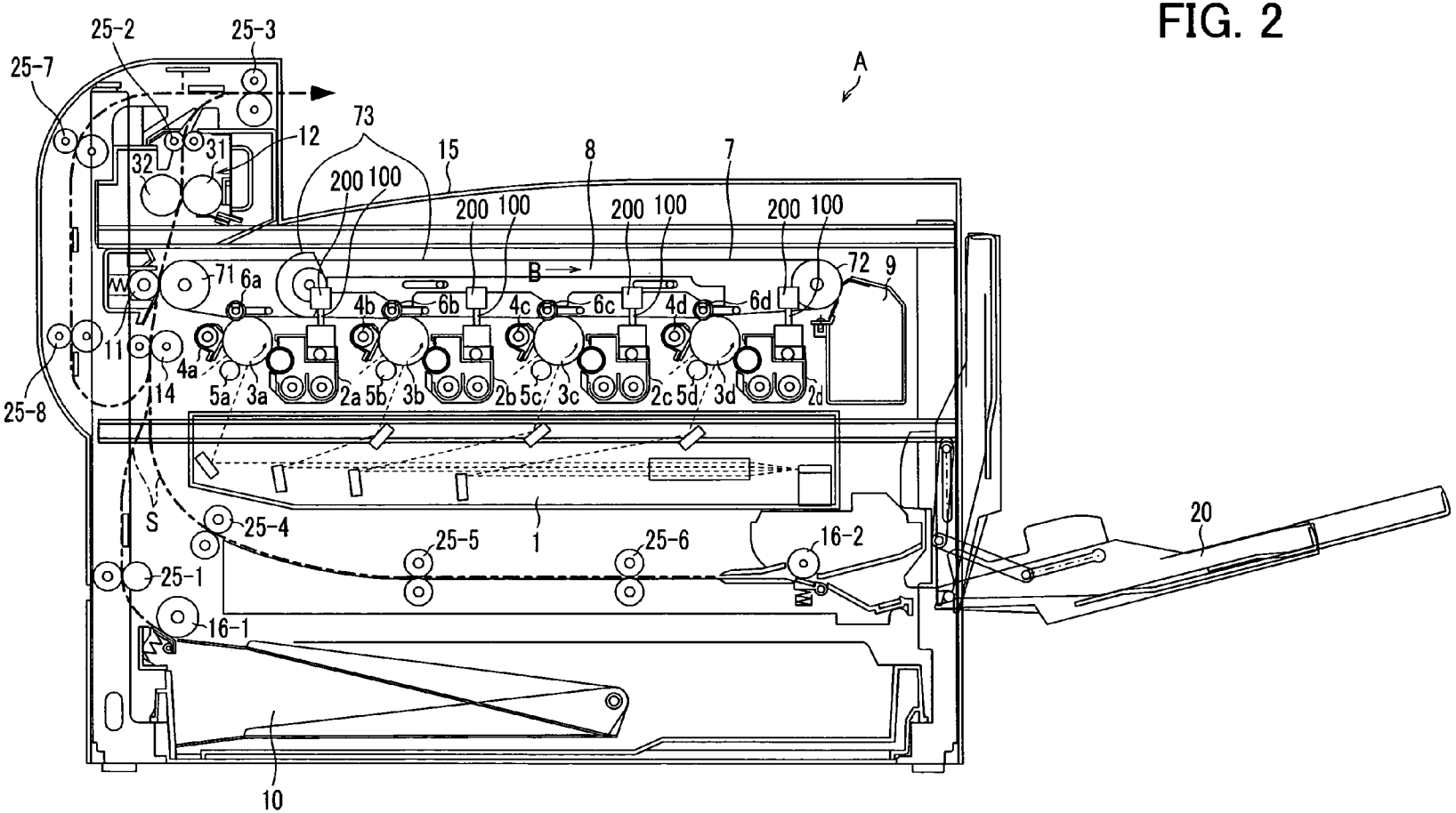
FIG. 2 is a cross section showing an image forming apparatus including the toner feeding apparatus shown in FIG. 1.

FIG. 2 shows an image forming apparatus A of the present embodiment. The image forming apparatus A forms a color image or a monochrome image on a sheet (recording sheet), based on either image data supplied from the outside or image data read out from a document.

As shown in the figure, the image forming apparatus A includes members such as an exposure unit 1, developing apparatuses 2, photosensitive drums 3, chargers 5, cleaner units 4, an intermediate transfer belt unit 8, a fixing unit 12, a sheet carrying path S, a sheet feeding tray 10, and a sheet ejection tray 15.

Image data of a color image, which is dealt with in the image forming apparatus A, corresponds to an image expressed by black (K), cyan (C), magenta (M), and yellow (Y). On this account, to form four types of electronic latent images corresponding to the respective colors, there are four developing apparatuses 2 (2*a*, 2*b*, 2*c*, and 2*d*), four photosensitive drums 3 (3*a*, 3*b*, 3*c*, and 3*d*), four chargers 5 (5*a*, 5*b*, 5*c*, and 5*d*), and four cleaner units 4 (4*a*, 4*b*, 4*c*, and 4*d*). As to the alphabets a-d, "a" corresponds to black, "b" corresponds to cyan, "c" corresponds to magenta, and "d" corresponds to yellow. These means with the respective alphabets constitute four image stations.

In the image station, the photosensitive drum 3 is provided in the upper part of the image forming apparatus A. The charger 5 evenly charges the surface of the photosensitive drum 3 to a predetermined electric potential. The charger 5 may be a contact-type roller shown in FIG. 2, a contact-type brush, or a charger type.

The exposure unit 1 is a laser scanning unit (LSU) including a laser irradiation section and a reflection mirror as shown in FIG. 2. Alternatively, the exposure unit 1 may adopt an EL or an LED writing head, in which light emitting elements are arrayed. The exposure unit 1 exposes a charged photosensitive drum 3 to light in accordance with input image data, so as to form, on the surface of the photosensitive drum 3, an electrostatic latent image in accordance with the image data.

Each developing apparatus 2 visualizes an electrostatic latent image formed on a photosensitive drum 3, by using K, C, M, and Y toners. The cleaner unit 4 removes residual toner on the surface of the photosensitive drum 3 after the steps of development and image transfer, and collects the toner.

Above the photosensitive drums 3, an intermediate transfer belt unit 8 is provided. This intermediate transfer belt unit 8 includes intermediate transfer rollers 6 (6*a*, 6*b*, 6*c*, and 6*d*), an intermediate transfer belt 7, an intermediate transfer belt drive roller 71, an intermediate transfer belt driven roller 72, an intermediate transfer belt tensioning mechanism 73, and an intermediate transfer belt cleaning unit 9.

The members such as the intermediate transfer rollers 6, the intermediate transfer belt drive roller 71, the intermediate transfer belt driven roller 72, the intermediate transfer belt tension roller 73 are used for tensioning the intermediate transfer belt 7 and rotating the belt 7 in the direction indicated by the arrow B.

The intermediate transfer rollers 6 are attached to intermediate transfer roller attaching sections of the intermediate transfer belt tensioning mechanism 73 of the intermediate transfer belt unit 8 in such a way as to be rotatable. The intermediate transfer rollers 6 provide transfer bias to transfer a toner image on the photosensitive drum 3 onto the intermediate transfer belt 7.

The intermediate transfer belt 7 is provided so as to be in touch with the photosensitive drums 3. Toner images with respective colors, which are formed on the respective photosensitive drums 3, are serially transferred onto the intermediate transfer belt 7 in such a way as to overlap one another, so that a color toner image (multicolor toner image) is formed on the intermediate transfer belt 7. The intermediate transfer belt 7 is a belt-shaped film which is 100 μm-150 μm thick.

Transfer from the photosensitive drums 3 to the intermediate transfer belt 7 is carried out by the intermediate transfer rollers 6 which are in touch with the back surface of the intermediate transfer belt 7. The intermediate transfer rollers 6 receive a high-voltage transfer bias (high voltage whose polarity (+) is in reverse to the polarity (−) of charged toner) in order to transfer toner images. Each of the intermediate transfer rollers 6 is formed around a metal (e.g. stainless) axis 8-10 mm in diameter, and the surface thereof is covered with a conductive elastic material (e.g. EPDM or urethane foam). Thanks to the conductive elastic material, the intermediate transfer rollers 6 can evenly charge the intermediate transfer belt 7 to a high voltage. Although in the present embodiment the transfer electrodes are roller-shaped (intermediate transfer roller 6), the transfer electrodes may be brush-shaped.

As discussed above, electrostatic latent images on the respective photoconductors 3 are visualized by toners with respective hues, and hence the electrostatic latent images are converted to toner images. The toner images are superposed over one another on the intermediate transfer belt 7. By the rotation of the intermediate transfer belt 7, the toner images thus superposed are moved to a position where a sheet which has been carried is in contact with the intermediate transfer belt 7, and the toner images are transferred to the sheet by the transfer roller 11 which is provided at that position. In doing so, the intermediate transfer belt 7 press-contacts the transfer roller 11 by a predetermined nip, and a voltage for transferring the toner image onto the sheet is applied to the transfer roller 11. The voltage is a high voltage whose polarity (−) is in reversed to the polarity (+) of charged toner.

To constantly obtain the nip, one of the transfer roller 11 and the intermediate transfer belt drive roller 71 is made of a hard material such as a metal, whereas the other is an elastic roller made of a soft material (e.g. elastic rubber roller or a foamed resin roller).

Toner which is adhered to the intermediate transfer belt 7 because the intermediate transfer belt 7 contacts the photosensitive drums 3 and toner which remains on the intermediate transfer belt 7 even after the transfer of a toner image from the intermediate transfer belt 7 to the sheet are removed and collected by the intermediate transfer belt cleaning unit 9, because such toner causes color mixture of toners in the subsequent step. The intermediate transfer belt cleaning unit 9 is provided with, for example, a cleaning blade as a cleaning member contacting the intermediate transfer belt 7. At a position where the cleaning blade contacts, the intermediate transfer belt 7 is supported from the back side by the intermediate transfer belt driven roller 72.

The sheet feeding tray 10 stores sheets for image formation, e.g. recording sheets. The sheet feeding tray 10 is provided below the image formation section and the exposure unit 1. On the other hand, the sheet ejection tray 15 provided in the upper part of the image forming apparatus A is used for placing printed sheets in a face-down manner.

The image forming apparatus A is also provided with a sheet carrying path S by which sheets are sent from the sheet feeding tray 10 or a manual sheet feeding tray 20 to the sheet ejection tray 15 via the transfer section 11 and the fixing unit 12. In the sheet carrying path S, a part from the sheet feeding tray 10 to the sheet ejection tray 15 is provided with members such as a pickup roller 16, resist rollers 14, the transfer section with the transfer roller 11, the fixing unit 12, and carrying rollers 25.

The carrying rollers 25 are small rollers to facilitate and assist the carrying of sheets, and are provided along the sheet carrying path S. The pickup roller 16 is provided at the edge of the sheet feeding tray 10, and is an attracting roller which supplies sheets one by one from the sheet feeding tray 10 to the sheet carrying path S. The resist rollers 14 temporarily keep a sheet carried in the sheet carrying path S and supplies the sheet to the transfer section at a timing that the leading edge of the toner image on the photosensitive drum 3 corresponds to the leading edge of the sheet.

The fixing unit 12 includes members such as a heat roller 31 and a pressure roller 32. The heat roller 31 and the pressure roller 32 rotate with a sheet being sandwiched therebetween. Temperature of the heat roller 31 is controlled by a control section (not illustrated) to be a predetermined fixing temperature. The control section controls temperature of the heat roller 31 based on a detection signal supplied from a thermometer (not illustrated). With the pressure roller 32, the heat roller 31 thermo-compresses a sheet so as to melt, mix, and press toner images with respective colors on the sheet. As a result, the toner images are thermally fixed to the sheet. The sheet after the multicolor toner image (toner images with respective colors) is fixed thereto is sent to a reverse sheet ejection path of the sheet carrying path S by means of multiple carrying rollers 25, and then ejected to the sheet ejection tray 15 in a reversed state (i.e. the multicolor toner images faces down).

The following will discuss a sheet carrying operation by the sheet carrying path S, which includes processes carried out in the respective sections. As discussed above, the image forming apparatus A has a sheet feeding tray 10 in which sheets are stored in advance and the manual sheet feeding tray 20 for, for example, printing a few sheets. Both of them are provided with the respective pickup rollers 16 (16-1 and 16-2). Each of the pickup rollers 16 supplies sheets one by one to the sheet carrying path S.

For single-side printing, a sheet supplied from the sheet feeding tray 10 is carried to the resist rollers 14 by the carrying rollers 25-1 in the sheet carrying path S. By these resist rollers 14, the sheet is then supplied to the transfer section at a timing that the leading edge of the sheet corresponds to the leading edges of superposed toner images on the intermediate transfer belt 7. In the transfer section, the toner images are transferred to the sheet. The toner images are fixed onto the sheet in the fixing unit 12. Thereafter, the sheet is ejected to the sheet ejection tray 15 by the carrying rollers 25-2 and the ejection rollers 25-3.

A sheet supplied from the manual sheet feeding tray 20 is fed to the resist rollers 14 by plural carrying rollers 25 (25-6, 25-5, and 25-4). Thereafter, the sheet is ejected to the sheet ejection tray 15 by the same process as the sheet supplied from the sheet feeding tray 10.

On the other hand, for duplex printing, the rear end of a sheet which has gone through single-side printing and has passed through the fixing unit 12 is nipped by the ejection rollers 25-3. Thereafter, the sheet is led to the carrying rollers 25-7 and 25-8 by the reverse rotation of the ejection rollers 25-3. After passing through the resist rollers 14 and going through back-side printing, the sheet is ejected to the sheet ejection tray 15.

In FIG. 2, above the developing apparatus 2, a toner carrier apparatus 100 is provided. Above this toner carrier apparatus 100, a toner cartridge (toner supply apparatus) 200 is provided. The developing apparatus 2 and the toner cartridge 200 are connected to one another by the toner carrier apparatus 100. Toner stored in the toner cartridge 200 is supplied to the developing apparatus 2 via the toner carrier apparatus 100.

Figure 1:
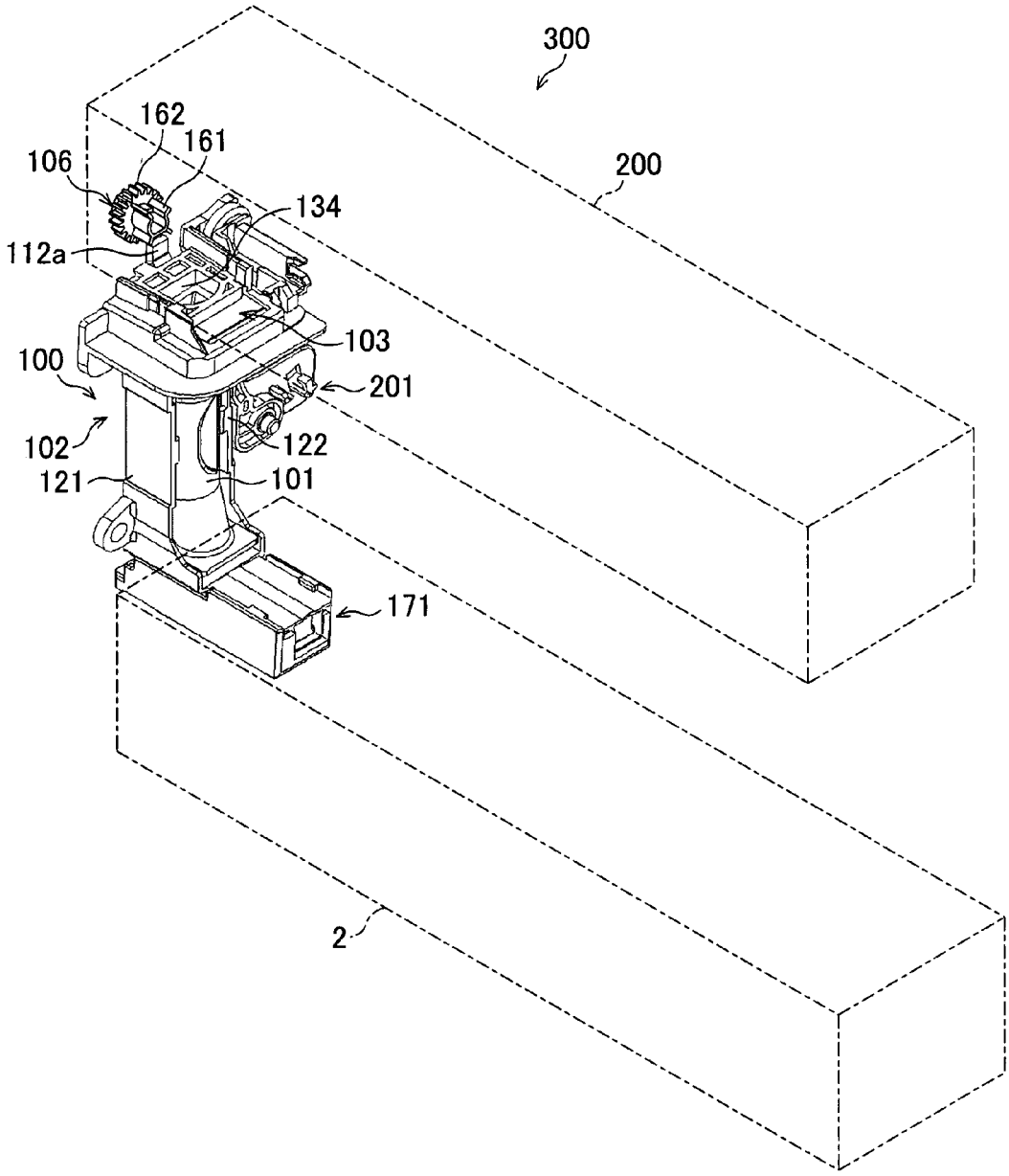
FIG. 1 is an oblique perspective view outlining a toner feeding apparatus according to an example embodiment.

FIG. 1 is an oblique perspective view of the toner feeding apparatus 300. This toner feeding apparatus 300 is provided with the developing apparatus 2, the toner carrier apparatus 100, and the toner cartridge 200. FIG. 1 portrays the developing apparatus 2 and the toner cartridge 200 as cubes indicated by chain double-dashed lines, in order to facilitate the understanding as to the structure of the toner carrier apparatus 100. The developing apparatus 2 and the toner cartridge may have conventional structures and functions.

In the present embodiment, the toner carrier apparatus 100, the toner cartridge 200, and the developing apparatus 2 are installed to form a square with one side missing. This installation is adopted because, as shown in FIG. 2, the intermediate transfer belt 7 operates between the toner carrier apparatus 100 and the developing apparatus 2.

Figure 3:
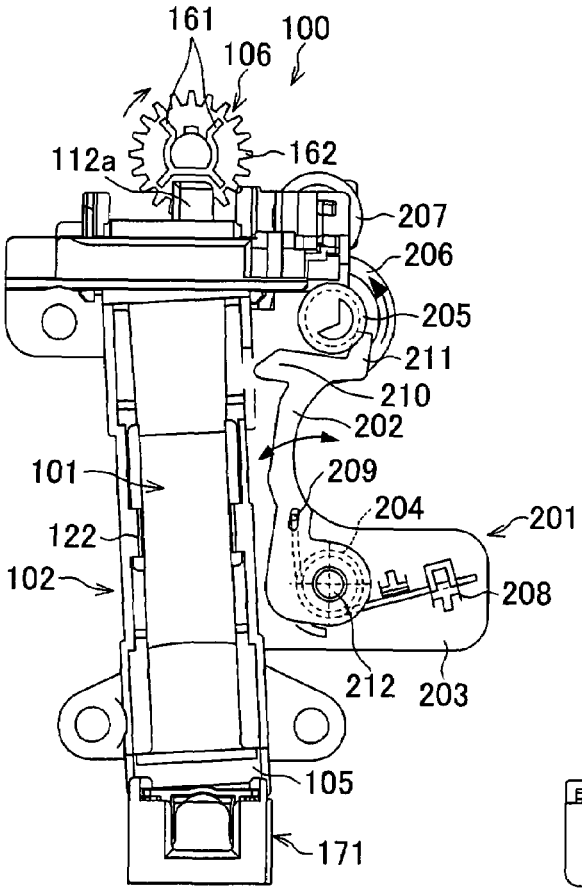
FIG. 3(*a*) is a frontal view of the toner carrier apparatus shown in FIG. 1.
Figure 3:
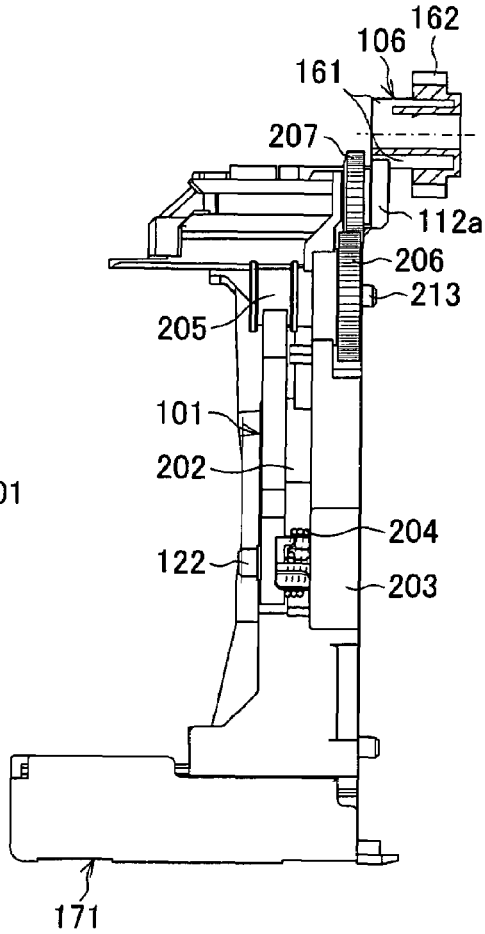
Figure 4:
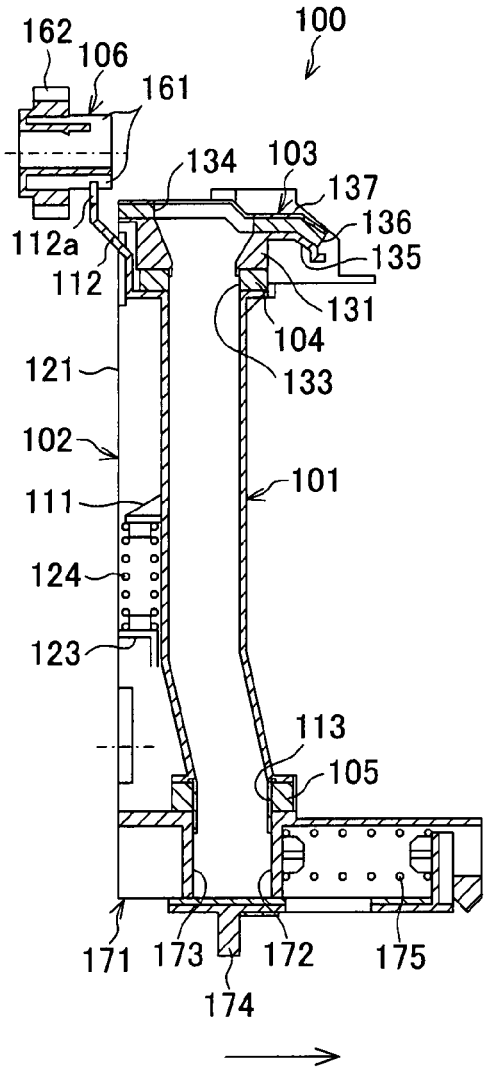
FIG. 4(*a*) is a vertical cross section of the toner carrier apparatus shown in FIG. 1, when a shutter is closed.
Figure 4:
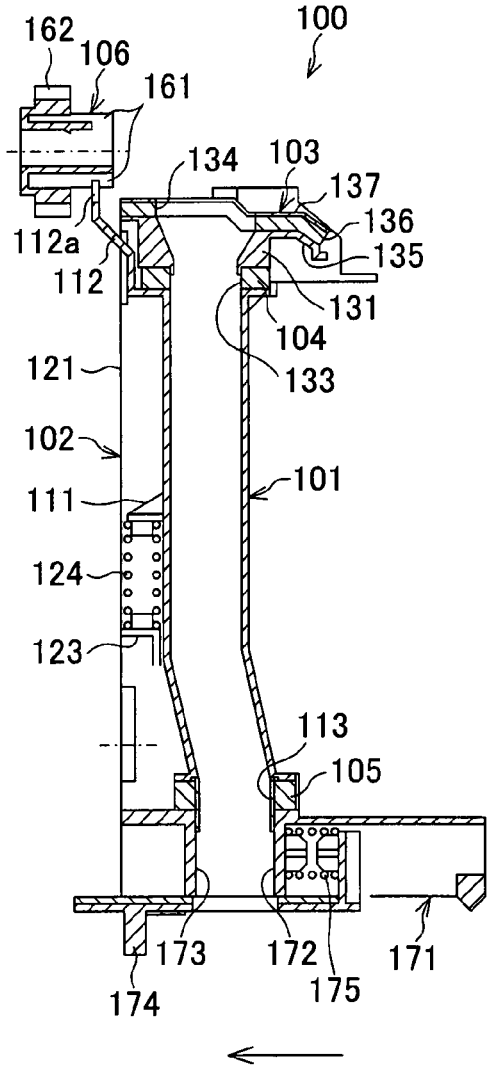

FIGS. 3(*a*) and 3(*b*) are a frontal view and a side view of the toner carrier apparatus 100, respectively. FIGS. 4(*a*) and 4(*b*) are vertical cross sections when the toner carrier apparatus 100 is viewed in profile. As shown in FIGS. 3(*a*), 4(*a*), and 4(*b*), the toner carrier apparatus 100 includes a toner carrier pipe (toner carrier member) 101, a sleeve (tubular member) 113, a pipe supporting member (supporting member) 102, an upper formed elastic member (elastic member) 104, a lower foamed elastic member (elastic member) 105, a rotational member (drive mechanism) 106, and a knocking mechanism (vibration mechanism) 201.

The toner carrier pipe 101 is a vertically-provided member shaped like a pipe, and includes a toner carrying path therein. This toner carrier pipe 101 is supported by the pipe supporting member 102 so as to be vertically movable. The back side of the toner carrier pipe 101 is covered with the pipe supporting member 102, and a spring lock section 111 is formed on the back side. At the upper end of the toner carrier pipe 101, a protruding section (drive mechanism). 112 is formed. A part of the upper end of this protruding section 112 further protrudes so as to form an operational protruding section 112*a*.

Inside the toner carrier pipe 101, which functions as the toner carrying path, is a circle-shaped hollow in the present embodiment, and the inner surface is smooth and curved. That is to say, the inside is a smooth surface without any bumps and dents where toner particles may accumulate.

The inner diameter of the toner carrier pipe 101 is smallest at the upper end. The inner diameter gradually increases towards the lower end, and is largest at the lower end. This arrangement allows toner, which is thrown in from the upper end, to smoothly reach the lower end without remaining in midstream. To achieve this, the difference between the inner diameter of the upper end and the inner diameter of the lower end is at least $\phi$0.1 mm, preferably not less than $\phi$0.2 mm.

In the present embodiment, the lower part of the toner carrier pipe 101 is curved. This is because the installation of the members in the image forming apparatus A is taken into consideration. The shape of the toner carrier pipe 101 is therefore not limited to this arrangement. For example, the pipe 101 may be a straight pipe.

To support the toner carrier pipe 101 and allow the pipe 101 to be vertically movable, the pipe supporting member 102 has an upper supporting section, a lower supporting section, and an intermediate supporting section 121 between the upper and lower supporting sections. The upper supporting section includes a supporting plate section 135 and a guiding pipe section 131. The lower supporting section is constituted by a carrier pipe sustaining section 171.

As shown in FIG. 1, the intermediate supporting section 121 is, for example, box-shaped. Around, for example, the central part of the intermediate supporting section 121 in the vertical direction, a supporting protruding section 122 is formed so as to protrude toward the toner carrier pipe 101. In this way, since a portion around the central part is supported by the supporting protruding section 122, the toner carrier pipe is allowed to vertically rock and horizontally swing.

On the inner surface of the intermediate supporting section 121, a spring lock section 123 is formed so as to face the back side of the toner carrier pipe 101, as shown in FIGS. 4(*a*) and 4(*b*). This spring lock section 123 is provided below the spring lock section 111 of the toner carrier pipe 101. Between these spring lock sections 111 and 123, a coil spring (drive mechanism) 124 which is a biasing member is provided. This coil spring 124 is a compression spring.

The upper supporting section of the pipe supporting member 102 is comprised by a supporting plate section 135 and a guiding pipe section 131 which is provided below the section 135. The guiding pipe section 131 guides toner, which has been thrown in through a toner inlet 134 of a toner cartridge applied section 103, to the toner carrier pipe 101. In consideration of this, the inner diameter of the guiding pipe section 131 at the lower end conforms with the inner diameter of the toner carrier pipe 101.

The lower end of the guiding pipe section 131 is connected to the upper end of the toner carrier pipe 101, with the upper foamed elastic member 104 being interposed therebetween. The upper foamed elastic member 104 has therein a toner path whose diameter conforms with the inner diameter of the toner carrier pipe 101 and is ring-shaped in order to prevent leakage of toner to outside. The upper surface of the upper foamed elastic member 104 is adhered to the lower end surface of the guiding pipe section 131, whereas the lower surface of the upper foamed elastic member 104 is adhered to the upper end surface of the toner carrier pipe 101.

To facilitate alignment for adhering the upper foamed elastic member 104 to the lower end surface, the lower end surface (adhesion surface) of the guiding pipe section 131 is provided with an alignment protruding section (alignment section) 133 which protrudes downward along the inner surface of the guiding pipe section 131 and is used for alignment of the upper foamed elastic member 104. The alignment protruding section 133 may have any shape on condition that the upper foamed elastic member 104 is aligned. For example, the alignment protruding section 133 is ring-shaped along the inner surface of the guiding pipe section 131, or the alignment protruding section 133 protrudes from the guiding pipe section 131, along the inner surface of the guiding pipe section 131.

In the present embodiment, the alignment protruding section 133 is formed on the lower end surface (adhesion surface) of the guiding pipe section 131. Alternatively, the alignment protruding section 133 may be formed on the adhesion surface at the upper end of the toner carrier pipe 101. If possible, two alignment protruding sections 133 may be formed on the respective adhesion surfaces.

A toner cartridge applied section (toner supply apparatus applied section) 103 is provided above the supporting plate section 135 comprising the upper supporting section of the pine supporting member 102. To allow toner to be thrown into the guiding pipe section 131, the toner cartridge applied section 103 has a toner inlet 134. The toner cartridge applied section 103 is plate-shaped. In the toner cartridge applied section 103, a foamed elastic member 136 and a mylar film 137 are disposed in this order. When the toner cartridge 200 is attached to or detached from the toner carrier apparatus 100, the toner cartridge 200 slides on the toner cartridge applied section 103. To prevent the foamed elastic member 136 from being worn and to allow the toner cartridge 200 to smoothly slide, the mylar film 137 is provided on the foamed elastic member 136 as described above. When the toner cartridge 200 is attached to the toner carrier apparatus 100, the toner outlet (not illustrated) of the toner cartridge 200 is aligned with the toner inlet 134 of the toner carrier apparatus 100.

In place of the mylar film 137, a PET (polyethylene terephthalate) film or a PTFE (polytetrafluoroethylene) film may be used, for example. That is to say, the layer provided above the foamed elastic member 136 is required to restrain the friction coefficient when the toner cartridge 200 is attached in a sliding fashion to be smaller than the friction coefficient of the surface of the foamed elastic member 136. Furthermore, the layer preferably has a high wear resistance.

The lower end of the toner carrier pipe 101 is connected to the carrier pipe sustaining section 171 of the pipe supporting member 102, via the lower foamed elastic member 105. The lower foamed elastic member 105 includes therein a toner path which conforms with the inner diameter of the toner carrier pipe 101. Also, the lower foamed elastic member 105 is ring-shaped in order to prevent toner from leaking to the outside. The upper surface of the lower foamed elastic member 105 is adhered to the lower end surface of the toner carrier pipe 101, whereas the lower surface of the lower foamed elastic member 105 is adhered to the upper surface of the carrier pipe sustaining section 171.

At the lower end portion of the inner wall (functioning as the toner carrying path) of the toner carrier pipe 101, a tube-shaped sleeve 113 is adhered to break up toner. The sleeve 113 extends below, passes through the lower end portion of the inner wall of the toner carrier pipe 101, and reaches the toner ejection path in the carrier pipe sustaining section 171. In the present embodiment, the sleeve 113 protrudes from the lower foamed elastic member 105 for 5 mm at the time of construction. However, the length of the protrusion from the lower foamed elastic member 105 is not limited to 5 mm.

Figure 5:
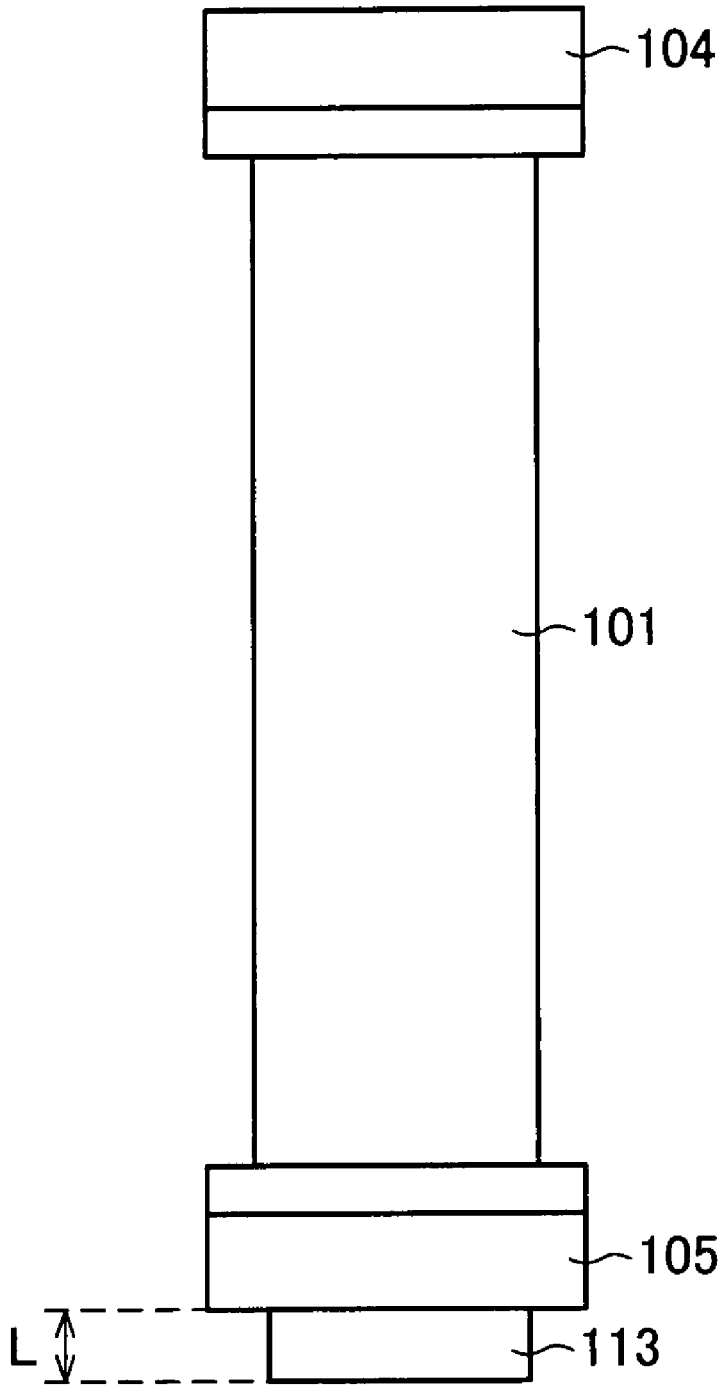
FIG. 5 is a frontal view of a toner carrier pipe, an upper foamed elastic member, a lower foamed elastic member, and a sleeve in the toner carrier apparatus.

FIG. 5 is a frontal view of, among the members the toner carrier apparatus 100, only the toner carrier pipe 101, the upper foamed elastic member 104, the lower foamed elastic member 105, and the sleeve 113. In the present embodiment, the length of the aforesaid protrusion is indicated by L in FIG. 5, and is 5 mm.

As discussed later, the sleeve 113 has a function to break up toner in the carrier pipe sustaining section 171. In addition to this, the sleeve 113 has a function to prevent misalignment, that is, to prevent the toner carrying path inside the toner carrier pipe 101, the toner path in the lower foamed elastic member 105, and the toner ejection path in the carrier pipe sustaining section 171 from significantly deviating from one another.

Figure 6:
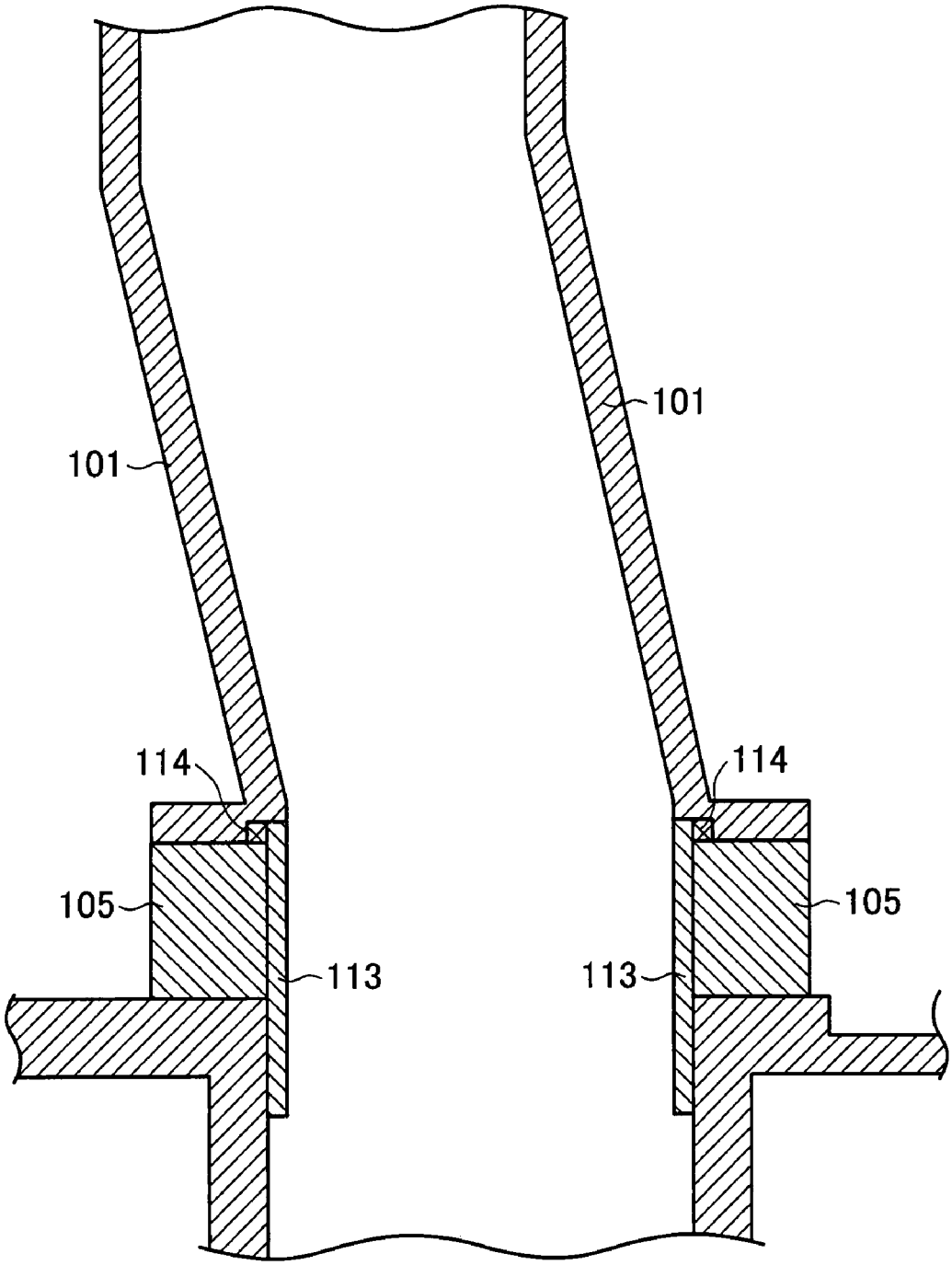
FIG. 6 is an enlarged view of surroundings of the sleeve shown in FIGS. 4(*a*) and 4(*b*).

FIG. 6 shows an enlarged vertical cross section around the sleeve 113 of FIGS. 4(*a*) and 4(*b*). As shown in FIG. 6, the sleeve 113 is adhered to the lower end portion of the inner wall of the toner carrier pipe 101, by means of an adhesive member 114. Non-limiting examples of the adhesive member 114 include a double-sided adhesive tape and an adhesive material. The sleeve 113 is basically in contact with the lower foamed elastic member 105 and the inner wall of the carrier pipe sustaining section 171, but the sleeve 113 is not adhered to these members. The sleeve 113 can therefore freely move and slide.

In the present embodiment, the inner diameter of the toner carrier pipe 101 is widened at the lower end portion (adhesion portion) of the inner wall of the toner carrier pipe 101, to which the sleeve 113 is adhered. On the wall surface where the diameter is widened, the adhesion member 114 and the sleeve 113 are deposited so that the inner wall of the sleeve 113 is smoothly connected with the inner wall of the toner carrier pipe, with no unevenness therebetween. In other words, the inner diameter of the toner carrier pipe 101 conforms with the inner diameter of the sleeve 113, at the joint therebetween.

Toner typically accumulates at a bump in the toner carrying path, and hence such a bump may cause toner to accumulate or coagulate. In the present embodiment, the toner carrier pipe 101 is smoothly connected with the sleeve 113. It is therefore possible to effectively restrain toner clogging.

The sleeve 113 may be formed by various methods such as resin molding. In the present embodiment, the sleeve 113 is formed by rolling a rectangular (square) mylar film which is 0.1 mm thick. Provided that the sleeve 113 is a pipe-shaped resin member, the sleeve 113 may not be properly attached when there is a metrication error in the outer diameter of the pipe-shaped resin member or in the inner diameter of the toner carrier pipe 101, e.g. the pipe-shaped resin member cannot be inserted into the toner carrier pipe 101, or the outer surface of the pipe-shaped resin member does not completely contact the inner wall of the toner carrier pipe 101. In this connection, the sleeve 113 of the present embodiment is formed by rolling a flexible mylar film, and hence the sleeve 113 cancels out a metrication error and can be properly adhered.

Going back to FIGS. 4(*a*) and 4(*b*), the carrier pipe sustaining section 171 is provided with a toner ejection path (toner path) 172, and the lower end portion of the toner ejection path 172 functions as a toner outlet 173 connected to the developing apparatus 2. The toner outlet 173 is provided with a slideable shutter 174. This shutter 174 is biased by a coil spring 175 which is an elastic member provided inside the carrier pipe sustaining section 171. When the toner carrier apparatus 100 is not attached to the developing apparatus 2, the shutter 174 is closed as shown in FIG. 4(*a*). On the other hand, as the toner carrier apparatus 100 is attached to the developing apparatus 2, the shutter 174 is pushed by the developing apparatus 2 so as to be opened as shown in FIG. 4(*b*).

The upper foamed elastic member 104 and the lower foamed elastic member 105 are deformed by an external force, and recover their original forms after the external force is removed. The toner carrier pipe 101 is connected to the toner cartridge applied section 103 via the upper foamed elastic member 104, and is also connected to the carrier pipe sustaining section 171 of the pipe supporting member 102 via the lower elastic member 105. On this account, the toner carrier pipe 101 is allowed to vertically move and to horizontally move (can horizontally swing) between the toner cartridge applied section 103 and the carrier pipe sustaining section 171.

The upper foamed elastic member 104 and the lower foamed elastic member 105 are comprised by foams comprising, for example, urethane, silicone, EPDM (ethylene-propylene-diene ternary copolymer), or polyolefin. An example of a foam comprised of EPDM is "Ept Sealer®" which is a commercial product of Nitto Denko Corporation.

In regard to cells in the upper foamed elastic member 104, individual cells are preferable as compared to communicating cells. The following will describe why individual cells are preferable.

In case where the upper elastic member 104 has communicating cells which are communicated with one another, basically toner tends to accumulate inside the upper foamed elastic member 104. If toner accumulates inside, the toner in the toner carrying path may erupt to the outside, when the upper foamed elastic member 104 expands or contracts. Also, if the accumulated toner coagulates, the upper foamed elastic member 104 cannot freely expand and contract. On the other hand, if the cells are individual cells which do not communicate with one another, toner does not accumulate inside the upper foamed elastic member 104 and hence the problems above are avoided.

In the present embodiment, since the inner wall of the lower foamed elastic member 105 is covered with the sleeve 113, the lower foamed elastic member 105 need not necessarily have individual cells. If the sleeve 113 is not provided, it is preferable that the lower foamed elastic member 105 also has individual cells.

The rotational member 106 is disposed in such a way that the axis direction is orthogonal to the vertical direction of the toner carrier pipe 101, around the upper end of the protruding section 112 of the toner carrier pipe 101. The rotational member is provided with (i) carrier pipe operation wings 161 on the protruding section 112 side in the axis direction, and (ii) a gear 162 on the side opposite to the carrier pipe operating wings 161 in the axis direction.

In the present embodiment, the rotational member 106 is rotated by a rotational force from a stir carrier member which stirs and carries toner in the toner cartridge 200. For this reason, the gear 162 of the rotational member 106 is engaged with another gear (not illustrated) which transfers the rotational force. Alternatively, the rotational member 106 may be rotated by an independent drive source, e.g. a dedicated motor. Since the rotational member 106 is provided to move the toner carrier pipe 101, the rotational member 106 functionally belongs to the toner carrier apparatus 100 but may be provided in the toner cartridge 200 in terms of structure.

In the present embodiment, four carrier pipe operation wings 161 are provided along the circumferential direction of the rotational member 106, with substantially equal intervals therebetween. The number of the carrier pipe operation wings 161 is not particularly limited. The carrier pipe operation wings 161 rotate in line with the rotation of the rotational member 106, and operate the toner carrier pipe 101 in the following manner.

First, one of the carrier pipe operation wings 161 contacts the operational protruding section 112*a* of the protruding section 112 of the toner carrier pipe 101, and the outer edge section of the wing contacts and slides on the upper end of the operational protruding section 112*a* so that the operational protruding section 112*a* is pushed down and the toner carrier pipe 101 is moved downward. Thereafter, the outer edge section of said one of the carrier pipe operation wings 161 detaches from the upper end of the operation protruding section 112*a* so that the toner carrier pipe 101 returns to the original position. As a result of these steps, the toner carrier pipe 101 vertically rocks (reciprocally moves).

Also, as a result of the steps above (one of the carrier pipe operation wings 161 contacts the operational protruding section 112*a* of the protruding section 112 of the toner carrier pipe, the outer edge section of said one of the carrier pipe operation wings 161 contacts and slides on the upper end of the operational protruding section 112*a*, and then the outer edge section of said one of the carrier pipe operation wings 161 detaches from the upper end of the operation protruding section 112*a*), the protruding section 112, i.e. the toner carrier pipe 101, receives a lateral force from the carrier pipe operation wings 161 so as to horizontally swing.

Figure 7:
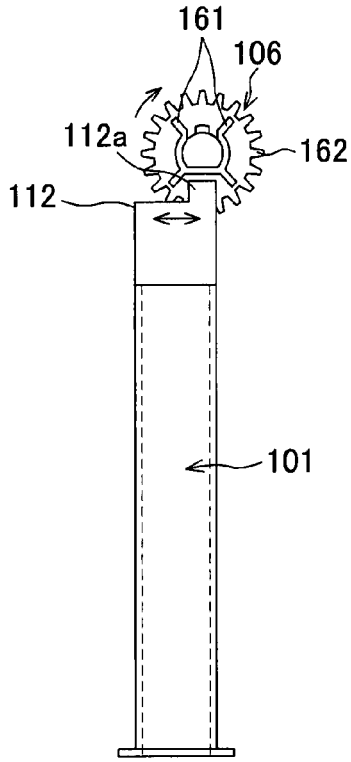
FIG. 7 shows a state where an operation wing of the rotational member is not in contact with a protruding section of a toner carrier pipe, in the toner carrier apparatus.
Figure 8:
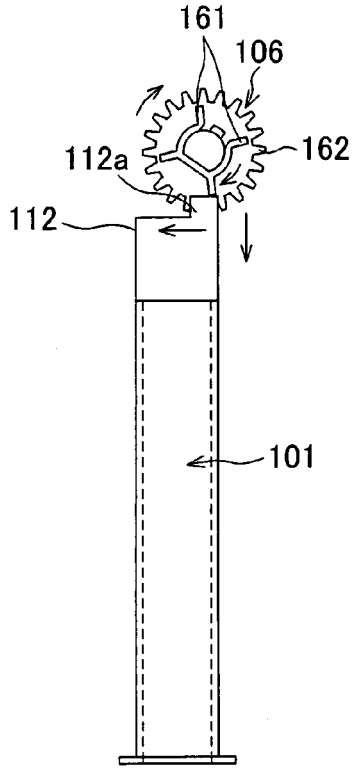
FIG. 8 illustrates that, in the toner carrier apparatus shown in FIG. 1, the toner carrier pipe is driven by the operation wings of the rotational member, so as to move downward and laterally swing.

As such, the toner carrier pipe 101 vertically rocks and horizontally swings, because the carrier pipe operation wings 161 operate the operational protruding section 112*a* of the protruding section 112. FIGS. 7 and 8 illustrate the aforesaid operation. Along with the toner carrier pipe 101, the sleeve 113 which is attached to the lower end portion of the inner wall of the toner carrier pipe 101 also vertically rocks and horizontally swings.

According to the above, in the toner feeding apparatus 300, the toner cartridge 200 is attached to the toner carrier apparatus 100 from above, whereas the developing apparatus 2 is attached to the toner carrier apparatus 100 from below. With these members being provided in this way, the rotational force of the stir carrier member provided in the toner cartridge 200 is transferred to the rotational member 106 of the toner carrier apparatus 100 so that the rotational member 106 is rotated. The toner carrier pipe 101 therefore vertically rocks and horizontally swings when toner is carried from the toner cartridge 200.

In the present embodiment, the rotational member 106 is rotated by a drive force applied to the stir carrier member, and the toner carrier pipe 101 is moved in accordance with the rotation. This seemingly put a burden on the drive source of the stir carrier member and in some cases slightly influence on the rotation of the stir carrier member. Such an influence on the rotation of the stir carrier member, however, does not at all have an adverse effect on the image quality of the image forming apparatus A which includes the toner feeding apparatus 300.

As shown in FIGS. 3(*a*) and 3(*b*), the knocking mechanism 201 is mainly comprised by a lever (knocking member) 202, a supporting plate 203, a coil spring (biasing member) 204, a notched cam (rotational member) 205, and gears 206 and 207.

The supporting plate 203 is fixed to the pipe supporting member 102, and has an attaching surface (lever attaching surface) where the lever 202 is attached. This lever attaching surface is substantially in parallel to the toner carrying path (provided in the vertical direction) in the toner carrier pipe 101. As shown in FIG. 3(*a*), the supporting plate 203 is provided on one side (on the right side in the present embodiment) of the toner carrier apparatus 100. On the lever attaching surface of the supporting plate 203, the flat-plate-shaped lever 202 is provided in a rotatable manner. The lever 202 can rotate around the rotational axis 212 which is close to the lower end, while the lever 202 is kept being in parallel to the supporting plate 203.

Between the supporting plate 203 and the lever 202, the coil spring 204 is provided. More specifically, on the lever attaching surface of the supporting plate 203, a latch member 208 is provided so as to protrude from the attaching surface, whereas a latch member 209 is provided so as to protrude from the surface, of the lever 202, which opposes the lever attaching surface. The coil spring 204 is provided around the perimeter of the rotational axis 212. One end of the coil spring 204 is hooked onto the latch member 208 on the supporting plate 203, whereas the other end is hooked onto the latch member 209 on the lever 202.

The coil spring 204 biases the lever 202 to rotate the same. More specifically, the coil spring 204 biases the lever 202 so that the upper part of the lever 202 moves toward the toner carrier pipe 101 (i.e. the lever 202 rotates counterclockwise in FIG. 3(*a*)).

In the upper part of the lever 202, a section to face the toner carrier pipe 101 is a knocking section 210 which horizontally protrudes toward the toner carrier pipe 101. Also, in the upper part of the lever 202, the side opposite to the aforesaid section facing the toner carrier pipe 101 is a cam engagement section 211 which protrudes upward. The knocking section 210 of the lever 202 is biased toward the toner carrier pipe 101 by the coil spring 204, so as to be capable of horizontally knocking the toner carrier pipe 101. In the meanwhile, the cam engagement section 211 of the lever 202 is engaged with the circumferential surface of the notched cam 205.

The notched cam 205 is arranged such that a substantially circular cam is notched in the shape of a fan. As shown in FIG. 3(*b*), the notched cam 205 is rotatably supported by an axis 213 which is orthogonal to the lever 202 and the supporting plate 203. On the axis 213, a gear 206 is provided to drive the notched cam 205. The gear 206 is engaged with another gear 207.

In the present embodiment, the gear 207 is rotated by the rotational drive force from the stir carrier member which stirs and carries toner inside the toner cartridge 200. For this reason, the gear 207 is engaged with a further gear (not illustrated) which transfers the rotational drive force. As such, simultaneously with stirring and carrying of toner inside the toner cartridge 200, the gear 207 is rotated so that the notched cam 205 is rotated via the gear 206. The notched cam 205 may not be driven in this way. For example, the notched cam 205 may be driven by a dedicated motor.

Figure 9:
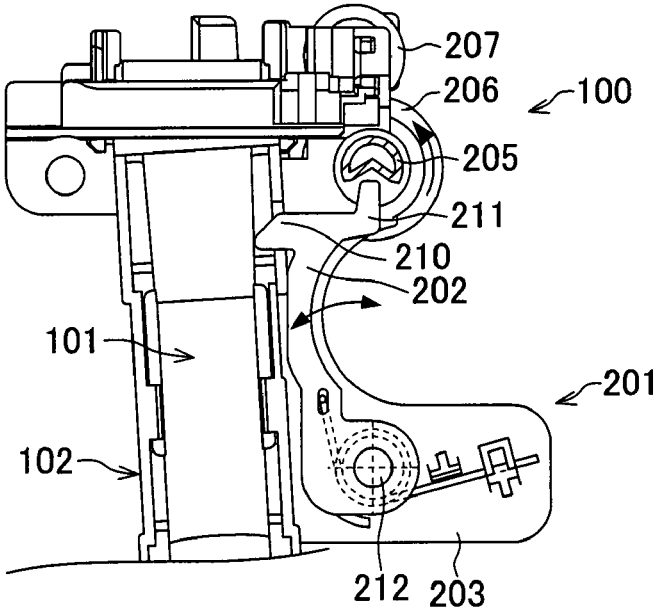
FIG. 9(*a*) shows a state where, in the toner carrier apparatus shown in FIG. 1, a knocking section of a lever knocks the toner carrier pipe.
Figure 9:
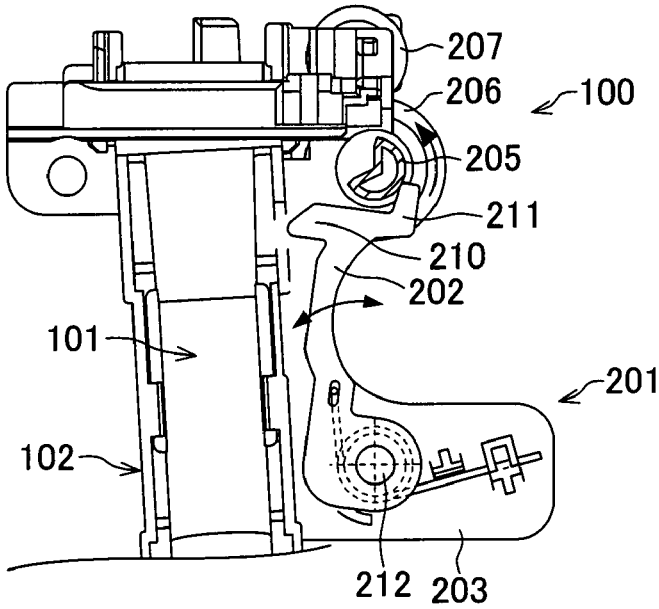

The cam engagement section 211 of the lever 202 contacts the circumferential surface of the notched cam 205, in the 4 to 5'o clock direction. As shown in FIG. 9(*b*), when the cam engagement section 211 of the lever 202 is in contact with a non-notched part of the circumferential surface of the notched cam, the lever 202 is not allowed to move toward the toner carrier pipe 101. That is to say, the upper part of the lever 202, where the knocking section 210 is provided, is biased toward the toner carrier pipe 101 by the coil spring 204. However, when the non-notched part of the notched cam 205 is positioned in the 4 to 5'o clock direction, the non-notched part prevents the aforesaid upper part from moving toward the toner carrier pipe 101.

On the other hand, as shown in FIG. 9(*a*), when the notched part is positioned in the 4 to 5'o clock direction of the notched cam 205, the cam engagement section 211 of the lever 202 does not contact the circumferential surface of the notched cam 205. Therefore, as the notched cam 205 is rotated and the notched part reaches the 4 to 5'o clock direction, the lever 202 is released from the notched cam 205 and hence the upper part of the lever 202 is moved toward the toner carrier pipe 101 by the biasing force of the coil spring 204. As a result, the knocking section 210 of the lever 202 knocks the toner carrier pipe 101.

In the state that the knocking section 210 of the lever 202 knocks the toner carrier pipe 101, the cam engagement section 211 is not far away from the notched cam 205. As the notched cam 205 is further rotated, the cam engagement section 211 of the lever 202 contacts the non-notched part of the notched cam 205 again. As a result, the upper part of the lever 202 is moved away from the toner carrier pipe 101, and the knocking section 210 of the lever 202 is detached from the toner carrier pipe 101 and returns to the state shown in FIG. 9(*b*).

In the present embodiment, the notched cam 205 has a single notch. Therefore the knocking section 210 of the lever 202 knocks the toner carrier pipe 101 once while the notched cam 205 rotates once. While toner is stirred and carried in the toner cartridge 200, the notched cam 205 continuously rotates, and hence the carrier pipe 101 is repeatedly knocked. The number of the notch of the notched cam 205 is one in the present embodiment, but plural notches may be provided.

Lastly, the following will discuss effects of the arrangements of the toner carrier apparatus 100.

By the stir carrier member inside the toner cartridge 200, toner in the toner cartridge 200 is thrown into the toner inlet 134 of the toner cartridge applied section 103 of the toner carrier apparatus 100. The toner passes through the guiding pipe section 131, the toner carrier pipe 101, and the toner ejection path 172, and the toner is supplied to the developing apparatus 2 through the toner outlet 173. At this point, because the developing apparatus 2 is attached to the toner carrier apparatus 100, the shutter 174 does not shut the toner outlet 173.

In the toner feeding apparatus 300, when toner is supplied from the toner cartridge 200 to the developing apparatus 2 via the toner carrier apparatus 100 as discussed above, the rotational member 106 is rotated by the drive force transferred to the stir carrier member of the toner cartridge 200. With this, the carrier pipe operation wings 161 of the rotational member 106 move the operational protruding section 112*a* of the toner carrier pipe 101, i.e. move the toner carrier pipe 101. On this account, the toner carrier pipe 101 vertically rocks as described above. It is therefore possible to prevent toner from accumulating in the toner carrier pipe 101, and from coagulating and causing improper toner carrying.

As such, in the toner carrier apparatus 100, a member such as a spring agitator, which induces accumulation of toner, is not provided in the toner carrier pipe 101, and accumulation and coagulation of toner in the toner carrier pipe 101 is prevented because the toner carrier pipe 101 vertically rocks. It is therefore possible to achieve high reliability in terms of prevention of accumulation and coagulation of toner.

Furthermore, along with the rotational member 106, the notched cam 205 is also rotated by the drive force transferred to the stir carrier member of the toner cartridge 200. With this, the lever 202 engaged with the notched cam 205 repeatedly knocks the upper part of the toner carrier pipe 101, thereby vibrating the toner carrier pipe 101.

The prevention of accumulation and coagulation of toner in the toner carrier pipe 101 of the toner carrier apparatus 100 is sufficiently achieved by vertically rocking the toner carrier pipe 101. In addition to this, the prevention of accumulation and coagulation is further ensured by knocking the toner carrier pipe 101. The prevention of accumulation and coagulation of toner is also ensured because the inner surface of the toner carrier pipe 101, which functions as a toner carrying path, is flat and has no irregularities.

Between the toner carrier pipe 101 and the toner cartridge applied section 103, the upper foamed elastic member 104 is provided, whereas, between the toner carrier pipe 101 and the carrier pipe sustaining section 171 of the pipe supporting member 102, the lower foamed elastic member 105 is provided. On this account, the toner carrier pipe 101 is sealed so that toner does not leak even if the toner carrier pipe 101 is vertically rocked. Furthermore, it is possible to laterally (horizontally) swing the toner carrier pipe 101.

In the present embodiment, the knocking section 210 of the lever 202 substantially horizontally knocks the toner carrier pipe 101, thereby causing the toner carrier pipe 101 to horizontally swing. In particular, in the present embodiment, the intermediate supporting section 121 supports the central part of the toner carrier pipe 101 in the vertical direction, and the lever 202 knocks the upper part of the toner carrier pipe 101. Therefore, being knocked by the lever 202, the toner carrier pipe 101 is rotated around the supporting point at which the intermediate supporting section 121 supports the toner carrier pipe 101.

As such, the toner carrier pipe 101 vertically and horizontally swings and is knocked. This remarkably ensures the prevention of accumulation and coagulation of toner.

The toner carrier pipe 101 is not necessarily knocked at the upper part. A similar effect can be obtained in case where the lower part of the toner carrier pipe 101 is knocked. In the meanwhile, in the present embodiment, the vibration mechanism by which the toner carrier pipe 101 is vibrated is the aforesaid knocking mechanism 201. Alternatively, toner carrier pipe 101 may be vibrated by pressing a conventional vibration member onto the toner carrier pipe 101.

Inside the toner carrier pipe 101, accumulation and coagulation of toner is prevented thanks to the aforesaid reciprocal movement and knocking. However, even if this arrangement is adopted, toner possibly coagulates and accumulates at the toner ejection path in the carrier pipe sustaining section 171 which is disposed downstream of the toner carrier pipe 101.

In the present embodiment, the sleeve 113 is provided at the lower end portion of the inner wall of the toner carrier pipe 101, which wall constitutes the toner carrier path, and the lower edge of the sleeve 113 can relatively freely move along with the toner carrier pipe 101. Therefore, as the toner carrier pipe 101 vertically or horizontally moves, the edge at the lower end of the sleeve 113 breaks up toner accumulating in the carrier pipe sustaining section 171 and facilitates the ejection. In addition, as the toner carrier pipe 101 is vibrated, the vibration may be transferred to toner in the toner ejection path inside the carrier pipe sustaining section 171 in order to break up accumulated toner. As such, the sleeve 113 is provided at the lower end of the toner carrier pipe 101 in order to facilitate the ejection of carried toner, and hence prevention of accumulation and coagulation of toner inside the toner carrier pipe 101 is further ensured.

In the present embodiment, the toner carrier pipe 101 is driven by a rotation-to-linear motion conversion mechanism which converts rotational motion to linear motion. In the present embodiment, the rotation-to-linear motion conversion mechanism is constructed by the rotational member 106, the protruding section 112, and the coil spring 124.

More specifically, the rotation-to-linear motion conversion mechanism is constructed by: the protruding section (operation receiving section) 112 provided in the toner carrier pipe (toner carrier member) 101; the rotational member 106 which operates the operational protruding section; and the coil spring (biasing member) 124 which biases the toner carrier pipe 101 upward, downward, or both. The rotational member 106 has plural operation wings 161 provided in the circumferential direction. In response to the rotation of the rotational member 106, the toner carrier pipe 101 repeatedly rocks in the vertical direction and swings in the horizontal direction, because the following steps are alternately repeated: one of the operation wings 161 contacts and slides on the surface of the protruding section 112 in opposition to a biasing force of the coil spring 124, and then said one of the operation wings 161 is detached from the surface of the protruding section 112. As a result, the toner carrier pipe 101 is moved vertically and horizontally.

With the arrangement above, it is possible to allow the toner carrier pipe 101 to move vertically and horizontally, by simply adopting a rotation-to-linear motion conversion mechanism. This further ensures prevention of accumulation and coagulation of toner in the toner carrying path.

The present invention is not limited to the description of the embodiments above, but may be altered by a skilled person within the scope of the claims. An embodiment based on a proper combination of technical means disclosed in different embodiments is encompassed in the technical scope of the present invention.

The present invention can be used for an image forming apparatus which supplies toner from a toner supply apparatus such as a toner cartridge to a developing apparatus provided below the toner feeding apparatus, via the toner carrier apparatus. Examples of such an image forming apparatus include photocopiers and printers.

As described above, a toner carrier apparatus of the present invention includes: a supporting member which supports a toner carrier member so that the toner carrier member is vertically movable; a drive mechanism which vertically moves the toner carrier member; and a vibration mechanism which vibrates the toner carrier member.

It is therefore possible to properly prevent toner from accumulating and coagulating in the toner carrying path.

The vibration mechanism preferably vibrates the toner carrier member in such a manner that a knocking member which is biased hits the toner carrier member.

According to this arrangement, the knocking member hits the toner carrier member so that the toner carrier member is vibrated. Since the knocking member is biased, the knocking member is sufficiently accelerated and the toner carrier member is sufficiently vibrated. It is therefore possible to effectively prevent toner from accumulating and coagulating in the toner carrying path.

The aforesaid toner carrier apparatus is preferably arranged such that the vibration mechanism is constituted by: the knocking member; a biasing member which biases the knocking member toward the toner carrier member; and a rotational member which is rotated so as to alternately repeat (i) a detaching movement by which the rotational member is engaged with the knocking member so that the knocking member is detached from the toner carrier member in opposition to a biasing force of the biasing member, and (ii) a cancellation movement by which the detaching movement is cancelled.

According to this arrangement, the toner carrier section is vibrated by a simple arrangement including a knocking member hitting the toner carrier section, a biasing member which biases the knocking member, and a rotational member which is engaged with the knocking member.

The aforesaid toner carrier apparatus is preferably arranged such that the rotational member is rotated by a drive source of a toner supply apparatus which supplies toner to the toner carrying path of the toner carrier member.

According to this arrangement, the rotational member is rotated by a drive force from, for example, a stir carrier member for toner, which member is provided inside a toner cartridge. On this account, the rotational member does not require a dedicated drive source, and hence the arrangement is simple. Also, the vibration mechanism is driven when toner is supplied to the toner carrying path. The driving is therefore sufficiently and laconically carried out.

The aforesaid toner carrier apparatus is preferably arranged such that the supporting member is constituted by (i) an upper supporting section which includes therein a toner path (ii) a lower supporting section which includes therein a toner path, and (iii) an intermediate supporting section which is disposed between the upper supporting section and the lower supporting section and supports the toner carrier member, and the toner carrying path of the toner carrier member is connected to the toner paths of the upper and lower supporting sections, via respective deformable elastic members including therein toner paths, the elastic members being disposed between an upper end of the toner carrier member and the upper supporting section and between a lower end of the toner carrier member and the lower supporting section, respectively.

According to this arrangement, the toner carrying path of the toner carrier member is connected to the respective toner paths of the upper supporting section and the lower supporting section of the supporting member, via the respective deformable elastic members including therein the toner paths. These elastic members properly seal a gap between the toner carrier member and the upper supporting section and a gap between the toner carrier member and the lower supporting member, without obstructing vertical movement of the toner carrier member.

The aforesaid toner carrier apparatus is preferably arranged such that the intermediate supporting section supports the toner carrier member in such a way as to allow the toner carrier member to horizontally swing, and the vibration mechanism is arranged such that the knocking member horizontally hits the toner carrier member.

According to this arrangement, the toner carrier member is connected at its upper and lower ends to the elastic members having toner paths, and is supported by the supporting member in such a way as to be capable of horizontally swinging. On this account, the toner carrier member can horizontally swing without causing leakage of carried toner. Since the vibration mechanism horizontally hits the toner carrier member, the toner carrier member is moved not only vertically but also horizontally. This further ensures prevention of accumulation and coagulation of toner.

The aforesaid toner carrier apparatus is preferably arranged such that the intermediate supporting section supports, in the vertical direction, a central part of the toner carrier member, and the knocking member hits a part of the toner carrier member, which part (on the upper end side or lower end side) is different from the central part at which the intermediate supporting section supports the toner carrier member.

According to this arrangement, the toner carrier member is swung in the rotation direction. This further ensures prevention of accumulation and coagulation of toner.

The aforesaid toner carrier apparatus preferably further includes a tubular member which is attached to an inner wall of the toner carrier member and protrudes downward from the inner wall, the inner wall constituting the toner carrying path.

According to this arrangement, toner which accumulates at the downstream of the toner carrying path is broken up by the tubular member. This further ensures prevention of accumulation and coagulation of toner.

The tubular member is preferably a tube formed by rolling a rectangular flexible film.

Provided that the tubular member is a pipe-shaped resin member, the tubular member may not be properly attached when there is a metrication error in the outer diameter of the pipe-shaped resin member or in the inner diameter of the toner carrier member, e.g. the pipe-shaped resin member cannot be inserted into the toner carrier member, or the outer surface of the pipe-shaped resin member does not completely contact the inner wall of the toner carrier member. According to the arrangement above, a rolled flexible film has a tendency to expand, and hence a metrication error is cancelled out and the tubular member is properly adhered.

The aforesaid toner carrier apparatus is preferably arranged such that the tubular member is adhered to an inner wall surface of the toner carrier member, the inner wall surface constituting the toner carrying path, and an adhesion region where the tubular member is adhered to the inner wall surface is larger in diameter than a neighboring region of the adhesion region, in order that an inner wall surface of the tubular member is smoothly connected to the neighboring region.

If a bump gap is formed when the tubular member is adhered to the inner wall surface of the toner carrier member, toner is likely to accumulate and coagulate because of the bump gap. According to the arrangement above, on the inner wall of the toner carrier member, an adhesion region where the tubular member is attached is smoothly connected to its neighboring region. This further ensures prevention of accumulation and coagulation of toner.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A toner carrier apparatus, comprising:

a toner carrier member which includes therein a toner carrying path through which toner is carried, the toner carrier member being disposed so that the toner carrying path extends vertically;

a supporting member which supports the toner carrier member in such a way as to allow the toner carrier member to be vertically movable;

a drive mechanism configured to vertically move the toner carrier member and to intermittently provide a vertical force to the toner carrier member, the toner carrier member entirely moving vertically due to the force provided by the drive mechanism, without transforming itself; and a vibration mechanism is configured to vibrate the toner carrier member.

2. The toner carrier apparatus as defined in claim 1, wherein, the vibration mechanism comprises a knocking member biased to hit the toner carrier member.

3. The toner carrier apparatus as defined in claim 1, further comprising a tubular member which is attached to an inner wall of the toner carrier member and protrudes downward from the inner wall, the inner wall constituting the toner carrying path.

4. The toner carrier apparatus as defined in claim 3, wherein, the tubular member is a tube formed by rolling a rectangular flexible film.

5. A toner carrier apparatus, comprising:

a toner carrier member which includes therein a toner carrying path through which toner is carried, the toner carrier member being disposed so that the toner carrying path vertically extends vertically;

a supporting member which supports the toner carrier member in such a way as to allow the toner carrier member to be vertically movable;

a drive mechanism which configured to vertically moves the toner carrier member;

a vibration mechanism configured to vibrate the toner carrier member;

the vibration mechanism comprising:

a biasing member configured to bias the knocking member toward the toner carrier member; and a rotational member configured to rotate so as to alternately repeat (i) a detaching movement by which the rotational member is engaged with the knocking member so that the knocking member is detached from the toner carrier member in opposition to a biasing force of the biasing member, and (ii) a cancellation movement by which the detaching movement is cancelled.

6. The toner carrier apparatus as defined in claim 5, wherein, the rotational member is configured to be rotated by a drive source of a toner supply apparatus which supplies toner to the toner carrying path of the toner carrier member.

7. A toner carrier apparatus, comprising:

a toner carrier member which includes therein a toner carrying path through which toner is carried, the toner carrier member being disposed so that the toner carrying path extends vertically;

a supporting member which supports the toner carrier member in such a way as to allow the toner carrier member to be vertically movable;

a drive mechanism configured to vertically move the toner carrier member;

a vibration mechanism configured to vibrate the toner carrier member;

wherein, the supporting member comprises (i) an upper supporting section which includes therein a toner path (ii) a lower supporting section which includes therein a toner path, and (iii) an intermediate supporting section which is disposed between the upper supporting section and the lower supporting section and supports the toner carrier member, and the toner carrying path of the toner carrier member is connected to the toner paths of the upper and lower supporting sections, via respective deformable elastic members including therein toner paths, the elastic members being disposed between an upper end of the toner carrier member and the upper supporting section and between a lower end of the toner carrier member and the lower supporting section, respectively.

8. The toner carrier apparatus as defined in claim 7, wherein, the intermediate supporting section is configured to support the toner carrier member in such a way as to allow the toner carrier member to horizontally swing, and the vibration mechanism is arranged such that the knocking member horizontally hits the toner carrier member.

9. The toner carrier apparatus as defined in claim 8, wherein, the intermediate supporting section is configured to support, in the vertical direction, a central part of the toner carrier member, and the knocking member is configured to hit a part of the toner carrier member, which part is different from the central part at which the intermediate supporting section supports the toner carrier member.

10. The toner carrier apparatus as defined in claim 7, further comprising a tubular member which is attached to an inner wall of the toner carrier member and protrudes downward from the inner wall, the inner wall comprising the toner carrying path, a lower end of the tubular member passing through the toner path inside the elastic member and reaching the toner path inside the lower supporting section.

11. The toner carrier apparatus as defined in claim 7, wherein, the elastic member comprises a foamed elastic member in which cells are independent of one another.

12. A toner carrier apparatus, comprising:

a toner carrier member which includes therein a toner carrying path through which toner is carried, the toner carrier member being disposed so that the toner carrying path extends vertically;

a supporting member which supports the toner carrier member in such a way as to allow the toner carrier member to be vertically movable;

a drive mechanism configured to vertically move the toner carrier member;

a vibration mechanism configured to vibrate the toner carrier member;

a tubular member which is attached to an inner wall of the toner carrier member and protrudes downward from the inner wall, the inner wall constituting the toner carrying path;

wherein, the tubular member is adhered to an inner wall surface of the toner carrier member, the inner wall surface comprising the toner carrying path, and an adhesion region where the tubular member is adhered to the inner wall surface is larger in diameter than a neighboring region of the adhesion region, in order that an inner wall surface of the tubular member is smoothly connected to the neighboring region.

13. A toner feeding apparatus, comprising:

a toner carrier apparatus including (a) a toner carrier member which includes therein a toner carrying path through which toner is carried, the toner carrier member being disposed so that the toner carrying path vertically extends, (b) a supporting member configured to support the toner carrier member in such a way as to allow the toner carrier member to be vertically movable, (c) a drive mechanism configured to vertically move the toner carrier member and to intermittently provide a vertical force to the toner carrier member, the toner carrier member entirely moving vertically due to the force provided by the drive mechanism, without transforming itself, and (d) a vibration mechanism configured to vibrate the toner carrier member;

a toner supply apparatus which is disposed above the toner carrier apparatus; and a developing apparatus which is disposed below the toner carrier apparatus and which is configured to receive toner from the toner supply apparatus via the toner carrier apparatus.

14. An image forming apparatus comprising a toner feeding apparatus, the toner feeding apparatus including:

a toner carrier apparatus including (a) a toner carrier member which includes therein a toner carrying path through which toner is carried, the toner carrier member being disposed so that the toner carrying path vertically extends, (b) a supporting member configured to support the toner carrier member in such a way as to allow the toner carrier member to be vertically movable, (c) a drive mechanism configured to vertically move the toner carrier member and to intermittently provide a vertical force to the toner carrier member, the toner carrier member entirely moving vertically due to the force provided by the drive mechanism, without transforming itself, and (d) a vibration mechanism configured to vibrate the toner carrier member;

a toner supply apparatus which is disposed above the toner carrier apparatus; and a developing apparatus which is disposed below the toner carrier apparatus and which is configured to receive toner from the toner supply apparatus via the toner carrier apparatus.

* * * * *